US006698107B2

(12) United States Patent
Song et al.

(10) Patent No.: US 6,698,107 B2
(45) Date of Patent: Mar. 2, 2004

(54) DRUM FOR CLOTHES DRIER

(75) Inventors: Sung Bae Song, Seoul (KR); Sang Wook Hong, Seoul (KR); Sang Heon Yoon, Seoul (KR); Hwan Joo Myung, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/042,227

(22) Filed: Jan. 11, 2002

(65) Prior Publication Data

US 2003/0000105 A1 Jan. 2, 2003

(30) Foreign Application Priority Data

Jun. 29, 2001 (KR) ..... 2001-38258
Dec. 4, 2001 (KR) ..... 2001-76302

(51) Int. Cl.[7] ..... F26B 11/02; F26B 25/06; D06F 58/00

(52) U.S. Cl. ..... 34/595; 599/602; 599/108; 599/318; 599/202; 68/24

(58) Field of Search ..... 34/599, 600, 601, 34/602, 603, 108, 130, 109, 132, 595, 604, 605, 606, 607, 608, 609, 610, 318, 322, 62, 202; 68/139, 142, 425, 498, 499

(56) References Cited

U.S. PATENT DOCUMENTS 2,296,257 A * 9/1942 Breckenridge ..... 68/24
2,330,420 A * 9/1943 Haberstump ..... 68/142
2,454,392 A * 11/1948 Jorgenson ..... 34/133
3,237,317 A * 3/1966 Huebsch ..... 34/133
3,270,529 A * 9/1966 Engel ..... 68/18
3,416,334 A * 12/1968 Candor et al. ..... 68/20
3,553,850 A * 1/1971 Schuurink ..... 34/133
3,605,281 A * 9/1971 Hubbard et al. ..... 34/133
3,645,010 A * 2/1972 Korekawa ..... 34/133
3,729,834 A * 5/1973 Fox ..... 34/139
3,811,202 A * 5/1974 Arendt ..... 34/133
3,938,357 A * 2/1976 Leib ..... 69/23
4,549,699 A * 10/1985 Thompson ..... 241/91
4,628,617 A * 12/1986 St. Louis ..... 34/108
4,974,339 A * 12/1990 Kawamura et al. ..... 34/73
5,371,956 A * 12/1994 St. Louis ..... 34/599
5,416,983 A * 5/1995 Moser ..... 34/250
5,421,103 A * 6/1995 Wunderlich ..... 34/599
5,724,750 A * 3/1998 Burress ..... 34/267
5,802,886 A * 9/1998 Kim ..... 68/142
5,901,465 A * 5/1999 Boussetta et al. ..... 34/602

* cited by examiner

*Primary Examiner*—Kenneth Rinehart
(74) *Attorney, Agent, or Firm*—Birch, Stewart, Kolasch & Birch, LLP

(57) ABSTRACT

In a drum for a clothes drier having a plurality of baffles projected from the inner circumference of the drum, lifting and moving clothes, a drum for a clothes drier comprises a cylindrical body housing clothes and rotating and a plurality of baffles projected from the inner circumference of the cylindrical body in a length direction of the cylindrical body and lifting the clothes, wherein at least one baffle is installed at each disposal domain and is formed so as to be inclined with respect to the length direction of the cylindrical body when the inner circumference of the cylindrical body is divided into a plurality of disposal domains in the length direction of the cylindrical body. Accordingly, because the clothes housed in the drum can be regularly dispersed, contact of the clothes and heating air can be performed well, accordingly clothes drying efficiency can be improved.

4 Claims, 13 Drawing Sheets

DRUM FOR CLOTHES DRIER

BACKGROUND OF THE INVENTION

1. Field of the Invention

The present invention relates to a drum for a clothes dryer and, in particular, to a drum for a clothes dryer having a plurality of baffles projecting from an internal circumference of a drum for lifting and moving clothes to be dried.

2. Description of the Background Art

Generally, a clothes dryer dries laundry by removing water from the laundry. Usually, the clothes dryer is installed beside a washer to be used upon completion of the washing process.

FIG. 1 is a sectional view illustrating a conventional clothes dryer. The conventional clothes dryer includes a casing 10 having a hexahedral shape so as to have an internal space, a rotating drum 30 supported by a roller R placed inside the casing 10, a driving motor 20 installed inside the casing 10 for generating a driving force in order to rotate the drum 30, a belt 40 and a pulley 41 connecting the driving motor 20 with the drum 30 for transmitting rotational force from the driving motor 20 to the drum 30, a circular rear plate 50 covering the rear side of the drum 30 and having an air suction port 51 constructed with a plurality of through holes, and a circular front plate 60 covering the front side of the drum 30 and having an input opening 61 and an air exhaust port 62. A plurality of air holes 11 is formed in the casing 10.

A suction duct 70 is connected to the air suction port 51 as a path through which air is drawn from outside into the drum 30. A heater (H) is installed at an inlet portion of the suction duct 70 for heating the intake air. An exhaust duct 80 is connected to the air exhaust port 62 to provide a path through which air from inside the drum 30 is discharged upon completion of the drying process. A fan 91 is installed inside the exhaust duct 80 for generating blasts by the driving motor 20.

A door (D) for opening/closing the clothes dryer is installed in a front surface of the casing 10, and a filter (F) for filtering impurities, such as lint, is installed inside the exhaust duct 80.

To operate the conventional clothes dryer, a user opens the door (D) in the front surface of the casing 10, puts clothes into the drum 30 through the input opening 61 and closes the door (D). When the user turns on an operation switch, power is applied to operate the driving motor 20.

The driving force generated by the driving motor 20 is transmitted to the drum 30 through the pulley 40 and the belt 41 to rotate the drum 30 and to operate the fan 91. The clothes in the drum 30 drop according to rotation of the drum 30. Simultaneously, air drawn from outside by the suction force of the fan 91 is heated by the heater (H), flows into the drum 30 through the suction port 51 to dry the clothes inside the drum 30, is exhausted through the exhaust port 62 and is discharged outside the casing 10 through the exhaust duct 80. A plurality of baffles 32 installed in an inner circumference of the drum 30 rotate together with the drum 30 to increase the area in contact with the heated air.

This process is performed continually until the clothes in the drum 30 are dry. When the drying process is finished, the user opens the door (D) and pulls out the dry clothes through the input opening 61.

As depicted in greater detail in FIG. 2, a sectional view taken along line A—A of FIG. 1, and FIG. 3, a perspective view of the drum, the drum 30 is constructed with a cylindrical body 31, and the plurality of baffles 32 project from the inner circumference of the cylindrical body 31 at regular intervals toward the center. The plurality of baffles 32 are formed along the length of the cylindrical body 31. In the embodiment shown, three baffles project from the inner circumference of the cylindrical body 31 at a 120° angle.

When the cylindrical body 31 rotates, the plurality of baffles 32 serves to move and lift the clothes inside the drum 30 to the upper portion of the drum 30. When the plurality of baffles 32 from which the clothes are hanging moves to an upper portion of the drum 30, the clothes drop freely from the upper portion to a bottom portion of the drum 30. The motion and heated air serve to dry the clothes in the drum.

However, in the conventional clothes dryer, because a length of the plurality of baffles 32 is the same as a length of the cylindrical body 31, it is difficult to disperse the clothes uniformly. As a result, the clothes clump around one place of the drum 30, and additional time is required to dry the clothes, thereby hampering dryer efficiency.

For example, as shown in FIG. 4, when the drum 30 rotates, heated air flows into the upper portion of the drum 30 and is exhausted through the exhaust port 62. Accordingly, the clothes tossed up to the upper portion of the drum 30 by the baffles 32 drop freely and clump around the exhaust port 62 due to the same flow of the air.

In addition, when the clothes clump around the exhaust port 62, it increases the friction of the air exhausted through the exhaust port 62, as well as the load on and noise of the fan 91.

SUMMARY OF THE INVENTION

In order to solve the above-mentioned problems, it is an object of the present invention to provide a drum for a clothes dryer which is capable of improving clothes drying efficiency by facilitating contact between clothes and heated air by providing a plurality of baffles to regularly disperse clothes housed inside a drum.

In order to achieve the above-mentioned object, a drum for a clothes dryer in accordance with the present invention includes a rotating cylindrical body for housing clothes, and a plurality of baffles projecting lengthwise from an inner circumference of the cylindrical body for lifting the clothes. The plurality of baffles is disposed so as to become more distant from or draw closer to the side of the cylindrical body gradually at regular intervals.

In another embodiment, a drum for a clothes dryer in accordance with the present invention includes a cylindrical rotating body for housing clothes, and a plurality of baffles projecting from an inner circumference of the cylindrical body lengthwise along the cylindrical body for lifting the clothes. At least one baffle is installed at each disposal domain, the inner circumference of the cylindrical body being divided into a plurality of disposal domains disposed lengthwise along the cylindrical body, each baffle being the same size as a width of each disposal domain at which each baffle is disposed and having the same width as each other. The plurality of baffles is formed so as to have the same interval in the circumferential direction of the cylindrical body.

A ratio (h/d) of a height (h) of each baffle to the inner diameter (d) of the cylindrical body is within the range of 1/10~2/10.

A ratio (1/L) of a length (l) of each baffle to a length (L) of the cylindrical body is greater than 3/10 and less than 10/10.

In the drum for the clothes dryer in accordance with another embodiment of the present invention, the plurality of disposal domains are set so as to have a region which overlaps each other.

In the drum for the clothes dryer in accordance with still another embodiment of the present invention, the disposal domains do not overlap each other.

In yet another embodiment, a drum for a clothes dryer in accordance with the present invention includes a rotating cylindrical body for housing clothes, and a plurality of baffles projecting from an inner circumference of the cylindrical body lengthwise along the cylindrical body for lifting the clothes, the plurality of baffles being inclined with respect to the length of the cylindrical body.

The cylindrical body sucks air through the side surface and discharges air through the other side surface, and the baffles placed at the side surface through which air is drawn are formed so as to be lower than the baffles placed at the other side surface from which air is discharged.

An angle of inclination ($\alpha$) of the plurality of baffles is $0° < \alpha \leqq 20°$ in the length direction of the cylindrical body.

The plurality of baffles is formed so as to be inclined with respect to a normal direction of the cylindrical body.

An angle of inclination ($\beta$) of the plurality of baffles is $0° < \beta \leqq 45°$ toward the normal direction of the cylindrical body.

A ratio (h/d) of a height (h) of each baffle to the inner diameter (d) of the cylindrical body is within the range of 1/10~2/10.

One of the baffles has a protrusion portion projecting from the end of the side from which air is discharged and having a certain height.

In a further embodiment, a drum for a clothes dryer in accordance with the present invention includes a rotating cylindrical body for housing clothes, and a plurality of baffles projecting from the inner circumference of the cylindrical body lengthwise along the cylindrical body. The cylindrical body sucks air through the side surface and discharges air through the other side surface, and one of the baffles has a protrusion portion projecting from the end of the side from which air is discharged and having a certain height.

In a still further embodiment, a drum for a clothes dryer in accordance with the present invention includes a rotating cylindrical body for housing clothes, and a plurality of baffles projecting from the inner circumference of the cylindrical body lengthwise along the cylindrical body, the plurality of baffles being formed so as to be inclined with respect to a normal direction of the cylindrical body.

The plurality of baffles is inclined with respect to the direction of rotation.

In yet another embodiment, a drum for a clothes dryer in accordance with the present invention includes a rotating cylindrical body for housing clothes, and a plurality of baffles projecting from an inner circumference of the cylindrical body lengthwise along the cylindrical body for lifting the clothes, wherein at least one baffle is installed at each disposal domain and is formed so as to be inclined with respect to the length of the cylindrical body when the inner circumference of the cylindrical body is divided into a plurality of disposal domains lengthwise along the cylindrical body.

BRIEF DESCRIPTION OF THE DRAWINGS

The accompanying drawings, which are included to provide a further understanding of the invention and are incorporated in and constitute a part of this specification, illustrate embodiments of the invention and, together with the description, serve to explain the principles of the invention.

In the drawings.

DETAILED DESCRIPTION OF THE PREFERRED EMBODIMENTS

Figure 1:
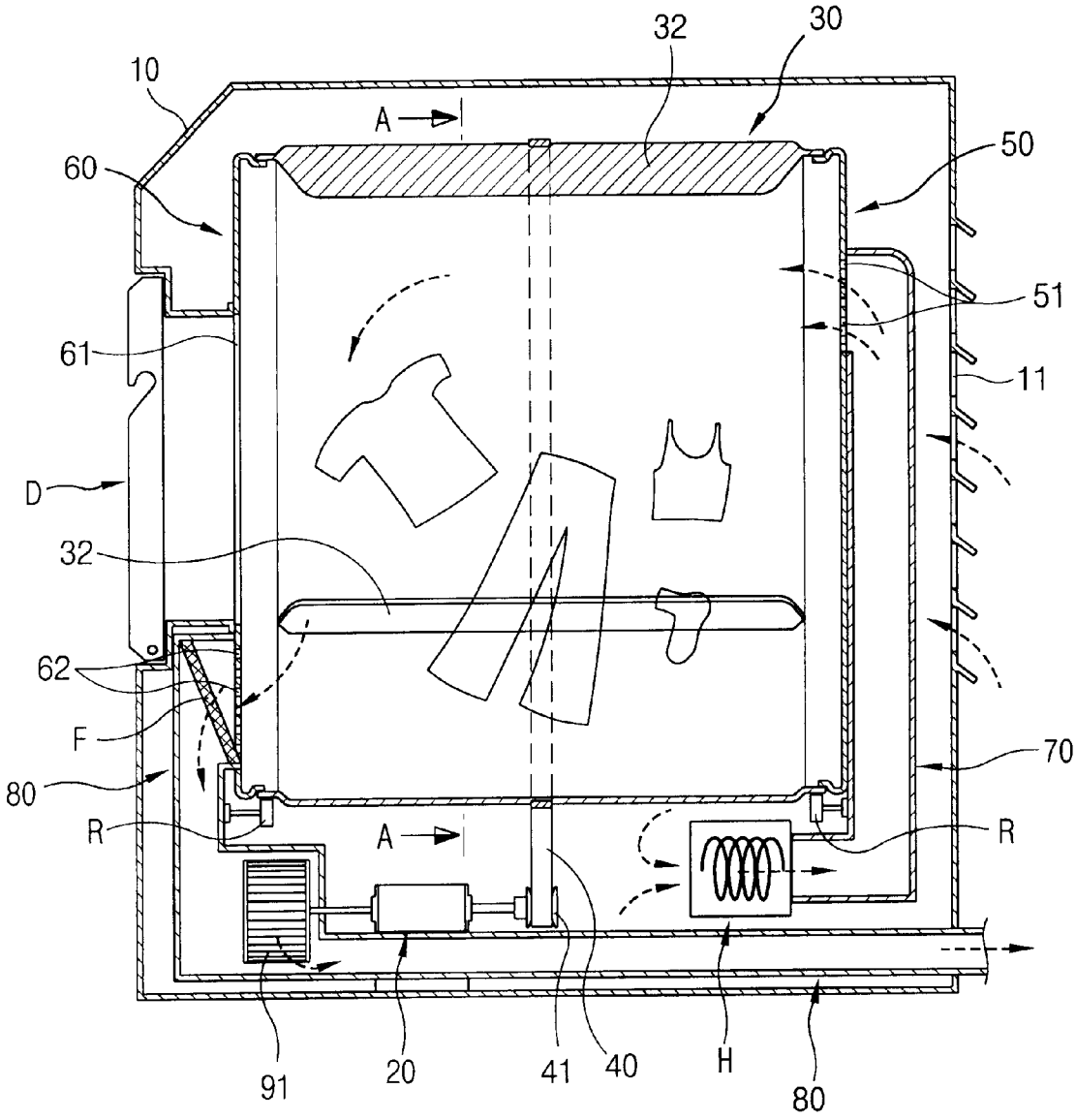
FIG.1 CONVENTIONAL ART
FIG. 1 is a longitudinal sectional view illustrating a conventional clothes dryer.
Figure 2:
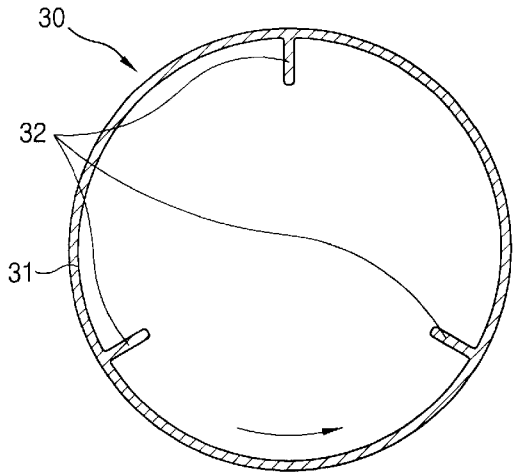
FIG.2 CONVENTIONAL ART
FIG. 2 is a sectional view illustrating a conventional drum taken along line A—A of FIG. 1.
Figure 3:
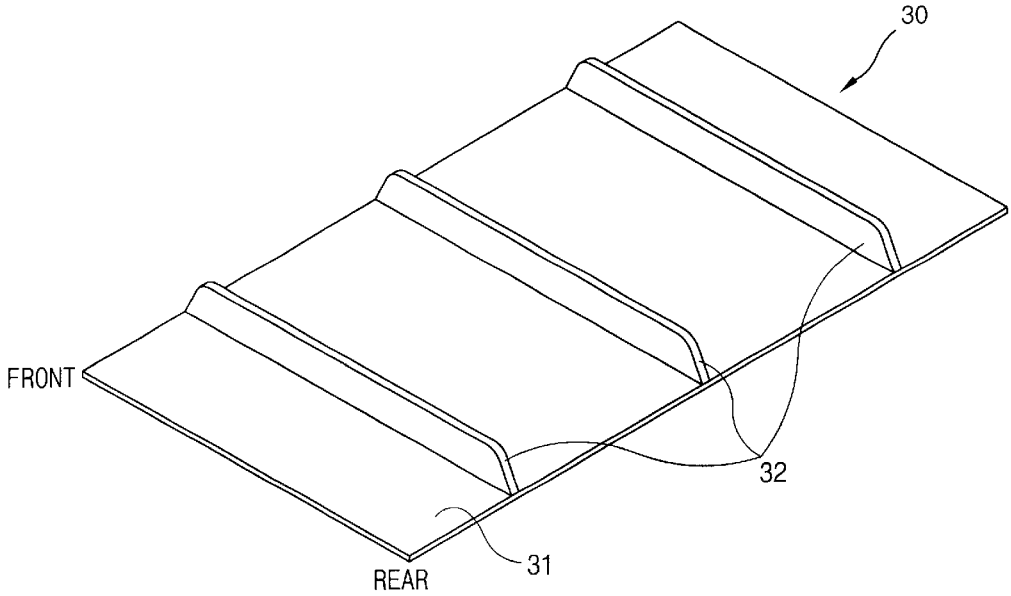
FIG.3 CONVENTIONAL ART
FIG. 3 is a perspective view illustrating the drum of the conventional clothes dryer.
Figure 4:
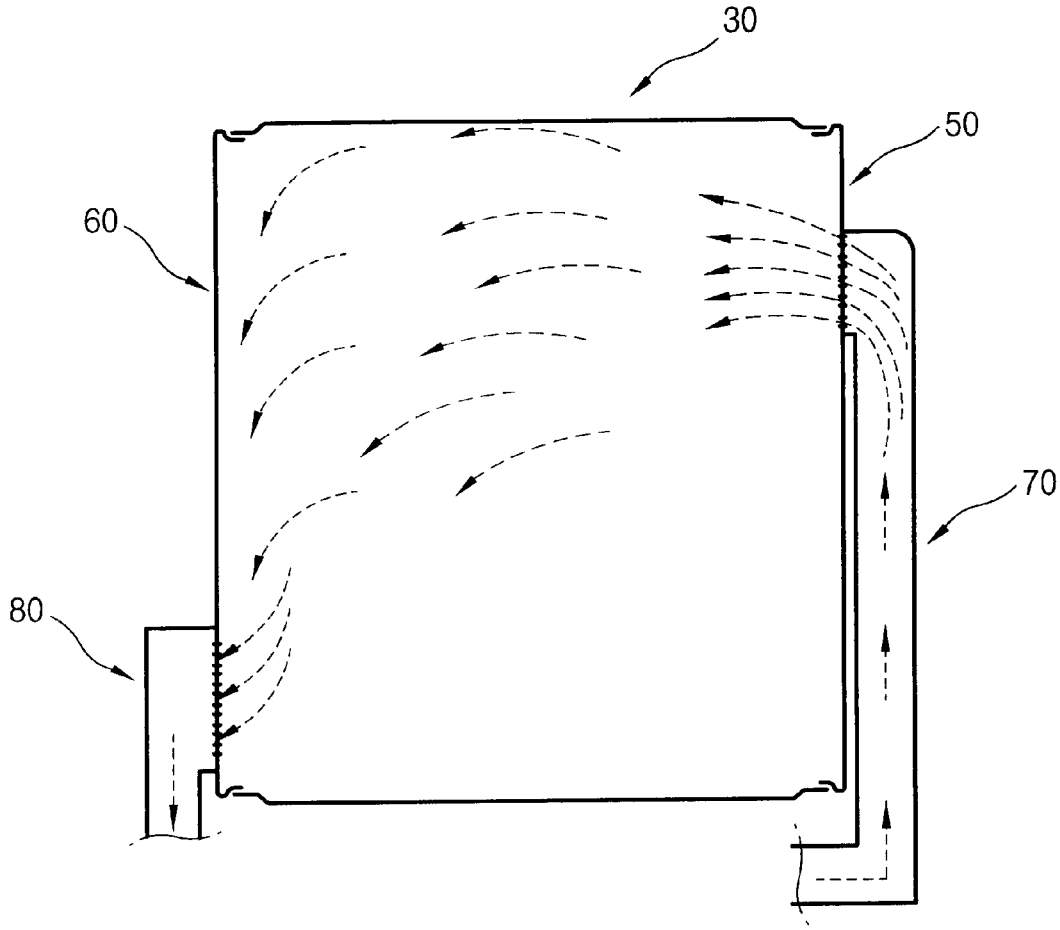
FIG.4 CONVENTIONAL ART
FIG. 4 is a longitudinal sectional view illustrating an air flow state in the conventional clothes dryer.

Hereinafter, embodiments of a drum for a cloth dryer in accordance with the present invention will be described in detail with reference to the accompanying drawings.

The same reference numerals will be given to the same parts as the conventional art.

FIGS. 5–8 illustrate a clothes dryer in accordance with a first embodiment of the present invention.

Figure 5:
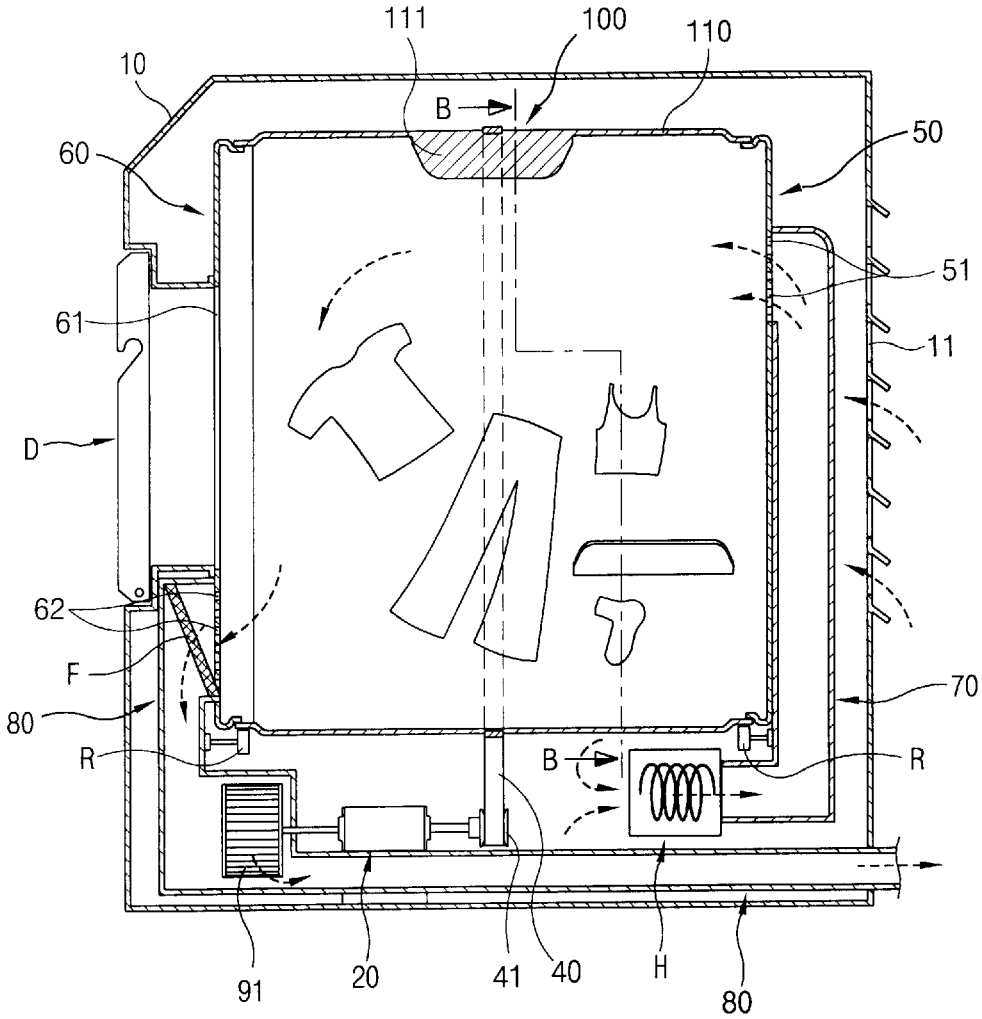
FIG. 5 is a longitudinal sectional view illustrating a clothes dryer in accordance with a first embodiment of the present invention.

As depicted in FIG. 5, in the clothes dryer in accordance with the first embodiment of the present invention, a cylindrical drum 100 is rotatively supported by a plurality of rollers inside a casing 10, and a driving motor 20 is installed at a internal lower portion of the casing 10. The driving motor 20 and the drum 100 are connected by a pulley 40 and a belt 41, and the driving force of the driving motor 20 is transmitted to the drum 100.

A circular rear plate 50 is attached to the drum 100 so as to cover a rear portion of the drum 100, and a suction port 51 having a plurality of holes therethrough is formed at an upper portion of the rear plate 50.

A suction duct 70 is connected to the suction port 51 of the rear plate 50 in order to draw outside air into the drum 100, and a heater (H) for heating the sucked air is installed at an inlet portion of the suction duct 70.

A circular front plate 60 is installed at a front portion of the drum 100 so as to cover the front portion of the drum 100. Provided in the front plate 60 are an input opening 61, through which a user puts/pulls clothes into/from the drum 100, and an exhaust port 62, constructed with a plurality of holes for exhausting air from inside the drum 100.

An exhaust duct 80, which extends to the outside of the casing 10, is connected to the exhaust port 62 of the front plate 60, and a fan 91 is installed inside the exhaust duct 80 in order to generate air flow by receiving the driving force from the driving motor 20.

Figure 6:
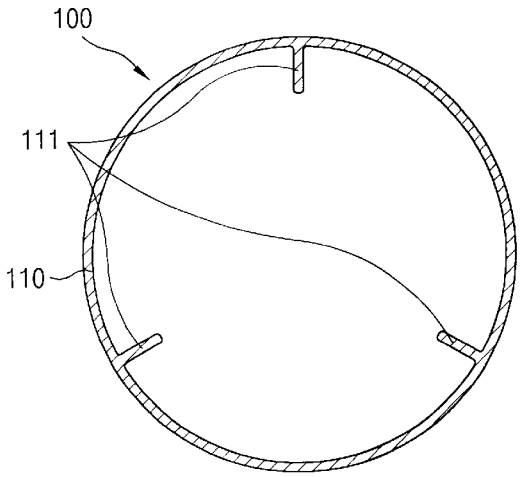
FIG. 6 is a sectional view illustrating a drum taken along line B—B of FIG. 5.
Figure 7:
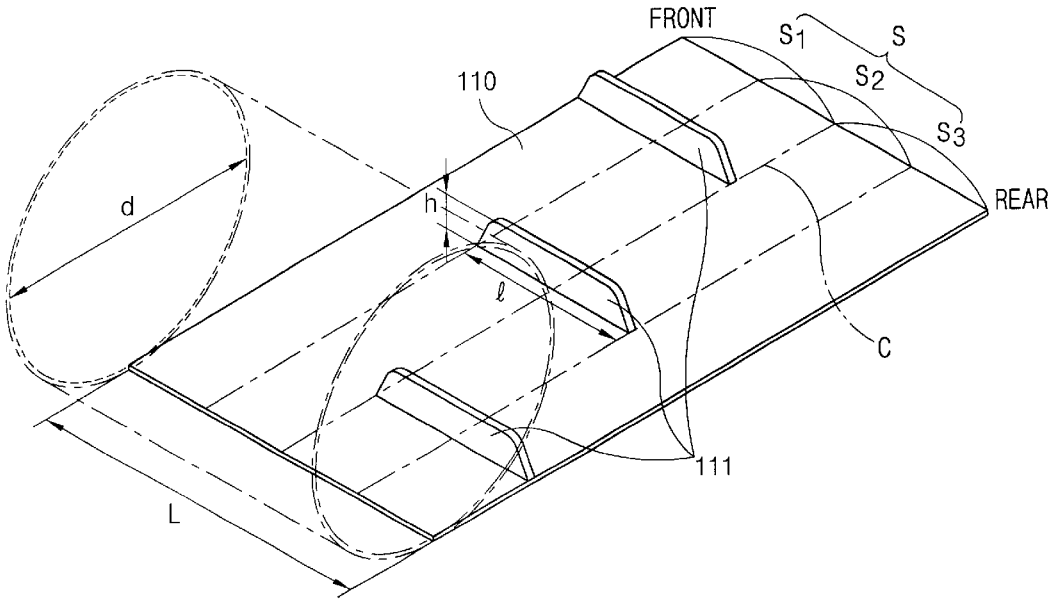
FIG. 7 is a perspective view illustrating the drum of the clothes dryer in accordance with the first embodiment of the present invention.

As depicted in FIGS. 6 and 7, the drum 100 includes a cylindrical body 110 for housing clothes and a plurality of baffles 111 projecting from disposal domains disposed on the inner circumference of the cylindrical body 110 and having a certain height.

The plurality of baffles 111 is placed so as to become progressively more distant from the side of the cylindrical body 110 at regular intervals.

The inner circumference of the cylindrical body 110 is divided into three disposal domains (S1), (S2), (S3), each having the same width and each disposal domain overlapping the next adjacent disposal domain to a specific degree.

With respect to a center line (C) at right angles relative to the length of the cylindrical body 110, a disposal domain (S) is demarcated into two disposal domains (S1) and (S3). As can be seen, one disposal domain (S2) overlaps with the disposal domains (S1) and (S3).

The disposal domains (S1), (S2), (S3) have a cylindrical shape and a specific width.

One of the plurality of baffles 111 is installed at each of the disposal domains (S1), (S2), (S3), each baffle 111 having the same length as the width of each disposal domain (S1), (S2), (S3) and each baffle 111 maintaining a specific distance from adjacent baffles in the circumferential direction of the cylindrical body 110.

Figure 8:
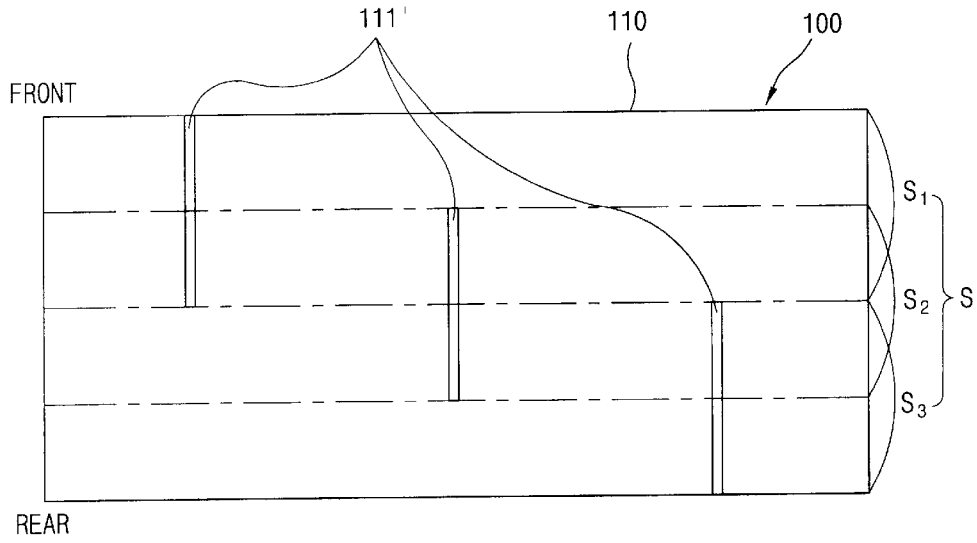
FIG. 8 is a perspective view illustrating an alternative drum structure for the clothes dryer in accordance with the first embodiment of the present invention.

As depicted in FIGS. 7 and 8, each of the three baffles 111 is installed in the order of the disposal domains (S1), (S2), (S3) in the rotational direction of the drum 100.

In comparison with the inner diameter (d) of the cylindrical body 110, a ratio (h/d) of the height (h) of each baffle 111 to the inner diameter (d) of the cylindrical body 110 is within the range of 1/10~2/10.

In addition, in comparison with a length (L) of the cylindrical body 110, a ratio (1/L) of a length (l) of each baffle 111 to a length (L) of the cylindrical body 110 is greater than 3/10 and less than 10/10.

In FIG. 5, unexplained reference numeral F is a filter, and reference numeral 11 is an suction hole through which air is sucked from outside.

The operation and the effects of the clothes dryer in accordance with the first embodiment of the present invention will be described in more detail.

A user opens the door (D), puts clothes into the drum 100 through the input opening 61 and closes the door (D). When the user turns on an operation switch, power is applied to the driving motor 20, and the driving motor 20 is operated. When the driving motor 20 is operated, the driving force of the driving motor 20 is transmitted to the drum 100 through the belt 40 and the pulley 41 to rotate the drum 100 and to operate the fan 91.

The clothes put into the drum 100 are tossed due to rotation of the drum. At the same time, air sucked through the suction duct 70 by the suction force of the fan 91 is heated by the heater (H), and the heated air flows into the drum 100 through the suction port S1 of the rear plate 50.

The heated air sucked into the drum 100 through the suction port 51 dries the clothes dropping rotatively inside the drum 100, is exhausted through the exhaust port 62, and is discharged through the exhaust duct 80.

The clothes housed inside the drum 100 move to the upper portion of the drum 100 by the plurality of baffles 111 respectively formed at the plurality of disposal domains (S) of the cylindrical body 110 of the drum 100 and drop, and the process is repeated.

Herein, because each baffle 111 of the drum 100 projects from each disposal domain and because the plurality of baffles 111 are formed in the circumferential direction as a plurality of platforms, the clothes can be regularly dispersed and moved inside the drum 100, and the clothes come into greater contact with the heated air, thereby improving clothes drying efficiency. In addition, clothes are prevented from clumping around the exhaust port 62, so that the clothes come into contact more easily with the heated air, and resistance against the air can be minimized.

The above-described process is performed continually until the clothes put into the drum 100 are dry, whereupon the user opens the door (D) and removes the clothes through the input opening 61.

Figure 9:
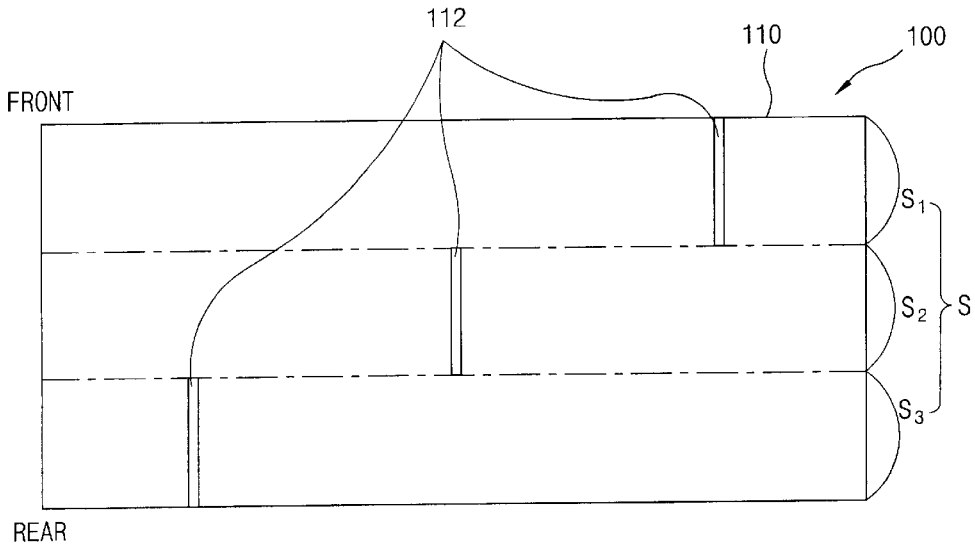
FIG. 9 is a perspective view illustrating a drum structure for a clothes dryer in accordance with a second embodiment of the present invention.

FIG. 9 is a development view illustrating a drum structure for a clothes dryer in accordance with a second embodiment of the present invention.

As depicted in FIG. 9, in the drum 100 in accordance with the second embodiment of the present invention, unlike the first embodiment of the present invention, the disposal domains at which each baffle is installed do not overlap each other.

In this configuration, the three disposal domains (S1), (S2), (S3), which do not one another, are demarcated on the inner circumference of the cylindrical body 110, one of baffles 112 having a specific height being installed at each disposal domain (S1), (S2), (S3).

Each baffle 112 is placed at each disposal domain (S1), (S2), (S3) so as to have a specific distance each other in the circumferential direction of the cylindrical body 110.

Herein, as depicted in FIG. 9, each of the three baffles 112 is installed in the order of the disposal domains (S1), (S2), (S3) from the front plate 60 to the rear plate 50 in the rotational direction of the drum 100.

Figure 10:
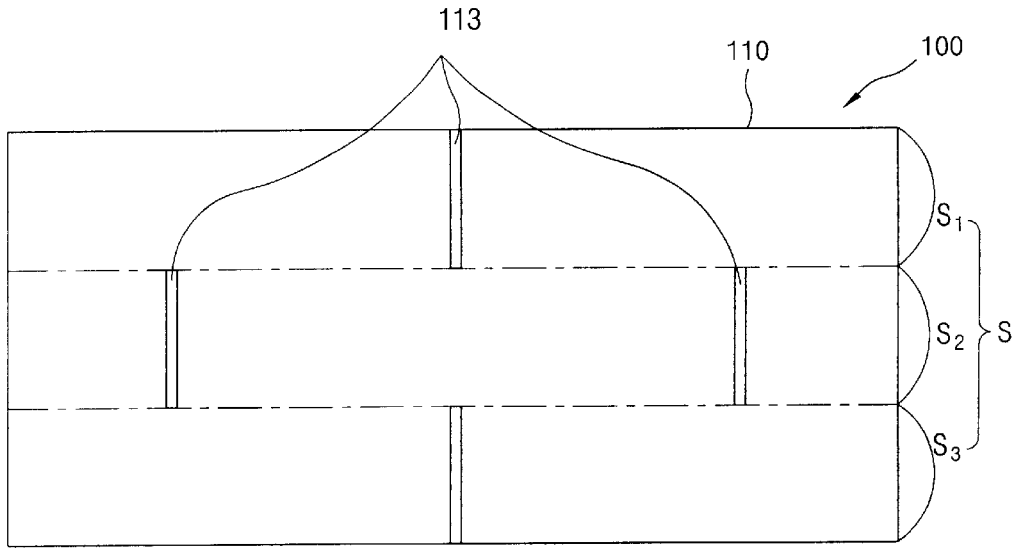
FIG. 10 is a perspective view illustrating a drum structure for a clothes dryer in accordance with a third embodiment of the present invention.

FIG. 10 is a perspective view illustrating a drum structure for a clothes dryer in accordance with a third embodiment of the present invention.

As depicted in FIG. 10, in the drum 100 in accordance with the third embodiment of the present invention, three disposal domains are demarcated so as not to be overlapped each other, and each baffle 113 having a specific height is installed to each disposal domain (S1), (S2), (S3).

In the three disposal domains (S1), (S2), (S3), one baffle is respectively formed at both sides disposal domains (S1), (S3) so as to place at the same line each other in the length direction. Two baffles are formed at the center disposal domain (S2) so as to have a certain distance from each baffle 113 formed at the side disposal domains (S1), (S3) in the circumferential direction.

A total of four baffles are placed at regular intervals in the circumferential direction.

Figure 11:
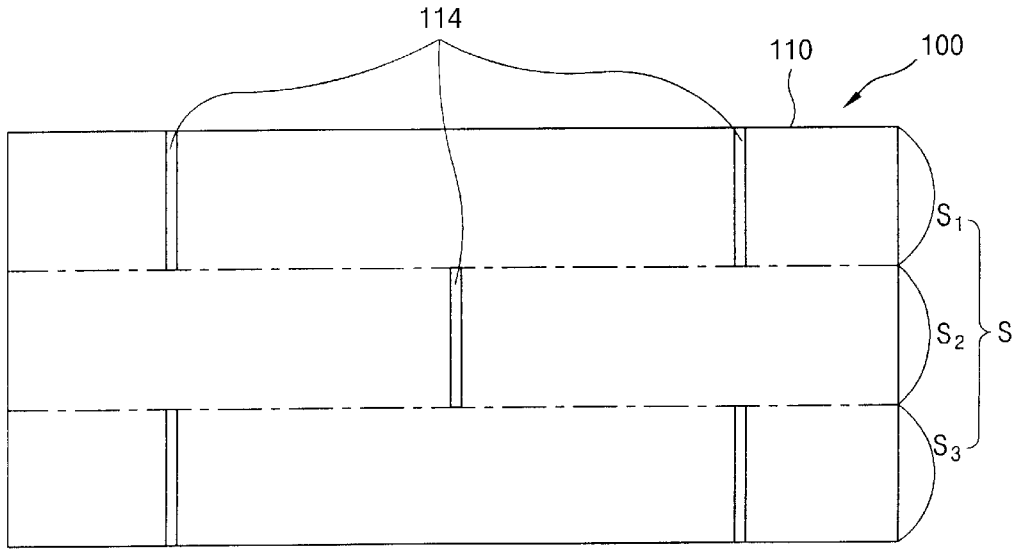
FIG. 11 is a perspective view illustrating a drum structure for a clothes dryer in accordance with a fourth embodiment of the present invention.

FIG. 11 is a perspective view illustrating a drum structure for a clothes dryer in accordance with a fourth embodiment of the present invention.

In the drum 100 in accordance with the fourth embodiment of the present invention, on the contrary to the baffle arrange structure in accordance with the third embodiment of the present invention, in three disposal domains (S1), (S2), (S3), two baffles 114 are respectively formed at both sides disposal domains (S1), (S3) so as to place at the same line each other in the length direction. One baffle is formed at the center disposal domain (S2).

A total of five baffles 114 are placed at regular intervals in the circumferential direction of the cylindrical body 110.

In the clothes dryer in accordance with the second, third and fourth embodiments of the present invention, because the plurality of baffles are formed in the circumferential direction as a plurality of platforms, it is possible to prevent the clothes from gathering around the exhaust port 62 and to disperse the clothes regularly inside the drum 100. Accordingly, the clothes can be easily contacted with the heating air, the flow resistance of the air can be minimized, clothes drying time can be shortened, and clothes drying efficiency can be improved.

FIGS. 12–16 illustrate a clothes dryer in accordance with a fifth embodiment of the present invention.

Figure 12:
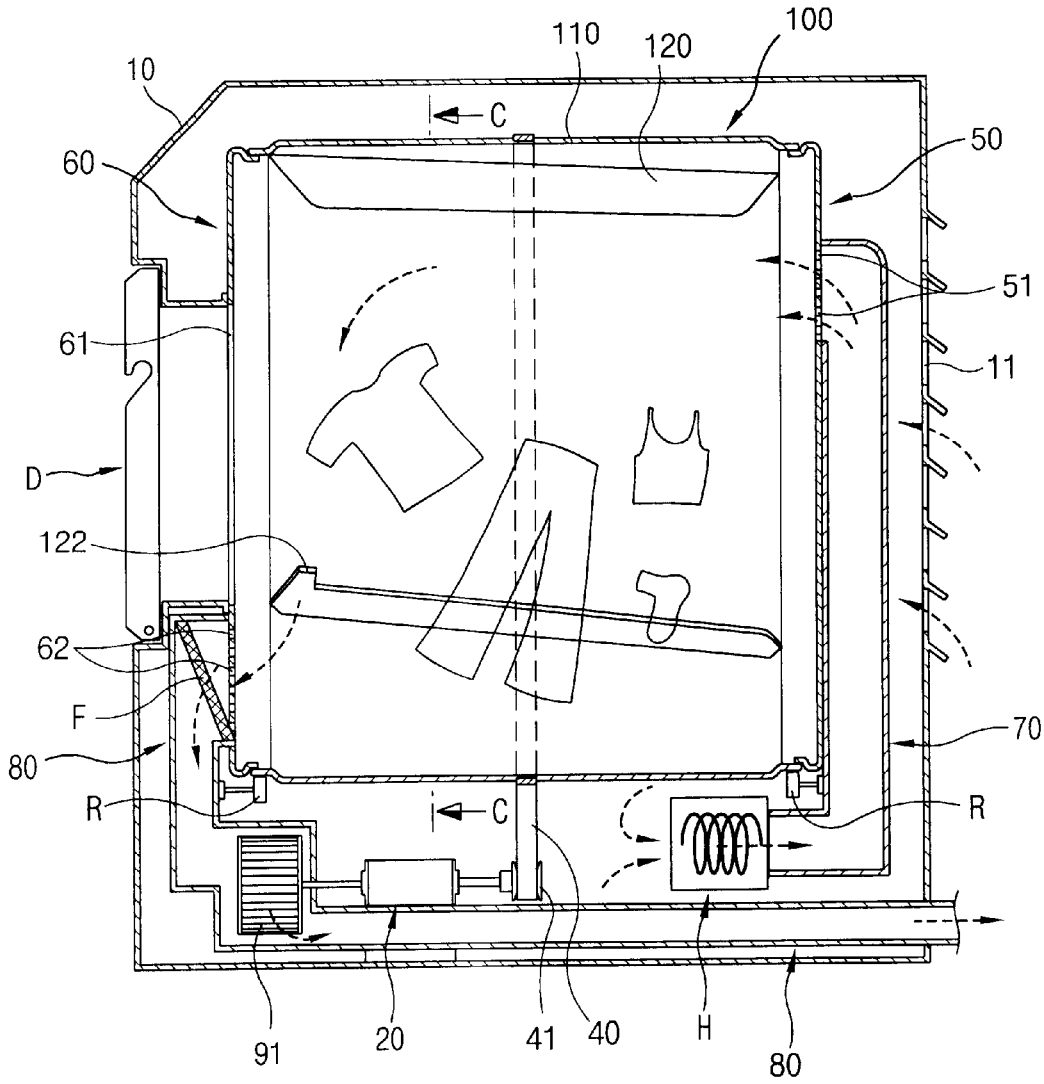
FIG. 12 is a longitudinal sectional view illustrating a drum structure for a clothes dryer in accordance with a fifth embodiment of the present invention.
Figure 13:
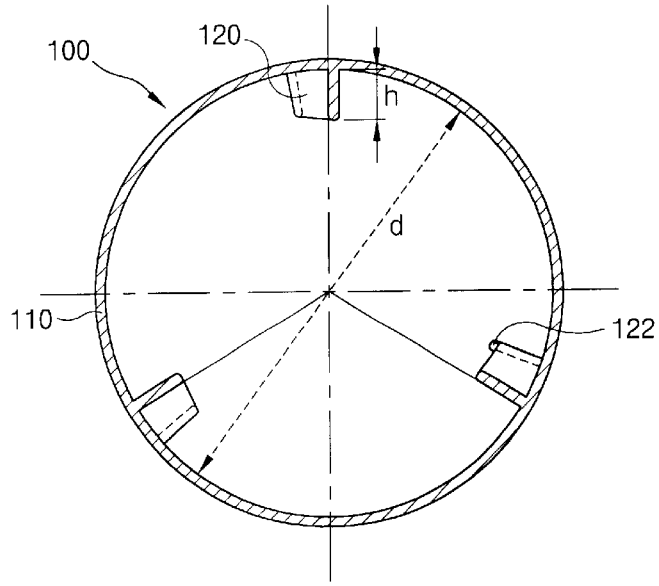
FIG. 13 is a sectional view illustrating the drum taken along line C—C of FIG. 12.

As depicted in FIG. 12, the clothes dryer in accordance with the fifth embodiment of the present invention includes the casing 10, the drum 100 rotatively installed inside the casing 10, and the driving motor 20 installed inside the casing 10 and rotating the drum 100.

The rear plate 50 is installed to the rear of the drum 100, and the front plate is installed to the front of the drum 100. The suction duct 70 is connected to the suction port 51 of the rear plate 50, and the heater (H) is installed to an inlet portion of the suction port 70.

The inlet opening 61 and the exhaust port 62 are formed at the front plate 60, and the exhaust duct 80 is connected to the exhaust port 62. The fan 91 rotated by the driving motor 20 is installed inside the exhaust duct 80.

Particularly, the drum 100 includes the cylindrical body 110 housing clothes and the plurality of baffles 120 projecting from the inner circumference of the cylindrical body 110 and moving the clothes when the cylindrical body 110 is rotated.

The baffles 120 are formed so as to be similar to the length of the cylindrical body 110 and are placed at regular intervals in the circumferenctial direction of the cylindrical body 110. The baffles 120 are inclined at a certain angle toward the length direction of the drum 100.

Figure 14:
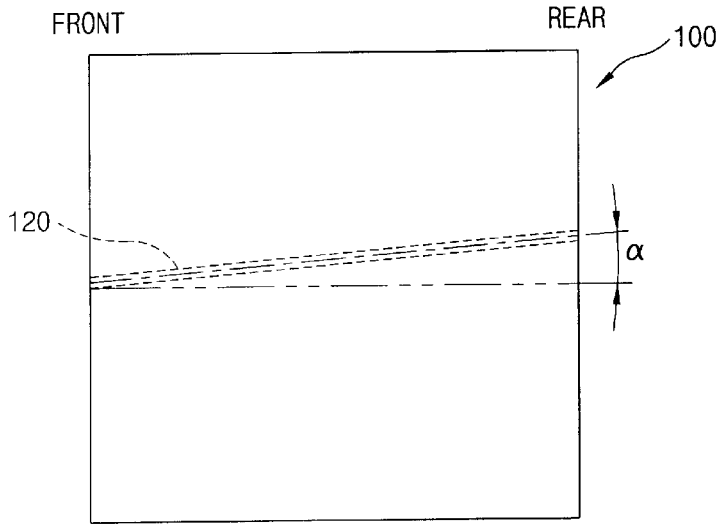
FIG. 14 is a side view illustrating an angle of inclination of a baffle of the drum in accordance with the fifth embodiment of the present invention.
Figure 15:
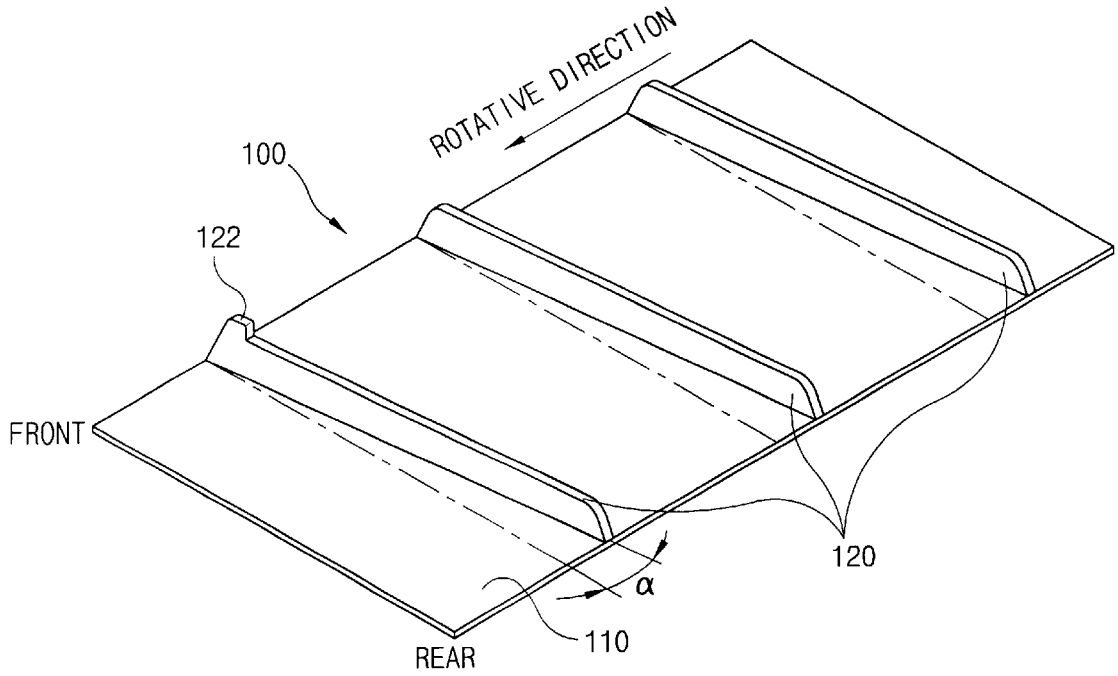
FIG. 15 is a perspective view illustrating the drum for the cloth dryer in accordance with the fifth embodiment of the present invention.

As depicted in FIG. 14, it is preferable to set an angle of inclination ($\alpha$) of the plurality of baffles 120 as $0° < \alpha \leqq 20°$.

In the plurality of baffles 120, on the basis of the baffle lifting the clothes in the rotational direction of the drum 100, a height of the baffle abutting on the rear plate 50 is lower than a height of the baffle abutting on the front plate 60.

A ratio (h/d) of the height (h) of each baffle 120 to the inner diameter (d) of the cylindrical body 110 is within the range of 1/10~2/10.

Figure 16:
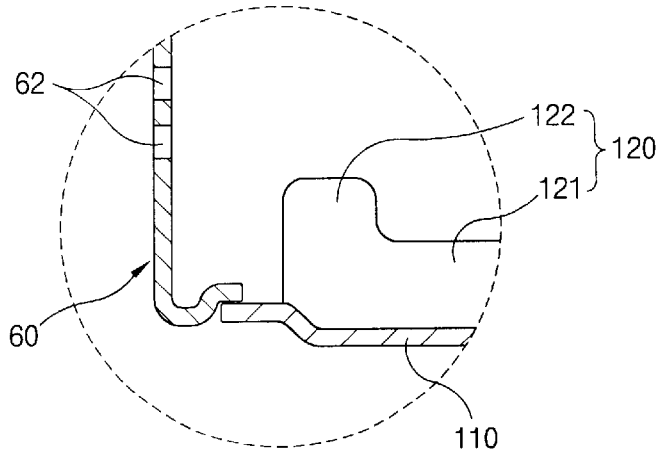
FIG. 16 is a detail drawing illustrating a protrusion portion formed at the baffle of the drum in accordance with the fifth embodiment of the present invention.

As depicted in FIG. 16, a protrusion portion 122 is formed at the end of a certain baffle of the baffles 120. In more detail, the baffle 120 having the protrusion portion 62 is constructed with a wing portion 121 projecting from the inner circumference of the cylindrical body 110 and the protrusion portion 122 projected relatively high from the end of the wing portion 121.

In the clothes dryer in accordance with the fifth embodiment of the present invention, by the baffles 120 projected so as to be inclined, the clothes can be regularly dispersed and moved inside the drum 100, and it is possible to prevent the clothes from gathering around the exhaust port 62.

In more detail, the heating air sucked into the drum 100 through the suction port 62 of the rear plate 50 flows inside the drum 100 and is exhausted through the exhaust port 62 of the front plate 60. At the same time, the clothes rotating together with the drum 100 by engaging with the baffles 120 are moved to the rear plate 50 at which the suction port 51 is formed in the inclination direction of the baffles 120.

Accordingly, the clothes come into prolonged contact with the heated air, and the clothes do not gather around the front plate 60 where the exhaust port 62 is formed, thereby improving drying efficiency.

In the meantime, as depicted in FIG. 16, because the protrusion portion 122 formed at one or more than one of the plurality of baffles 120 has the larger engaging area with the clothes, the clothes can be more easily dispersed, and it is possible to prevent the clothes from gathering around the exhaust port 62 more efficiently.

Figure 17:
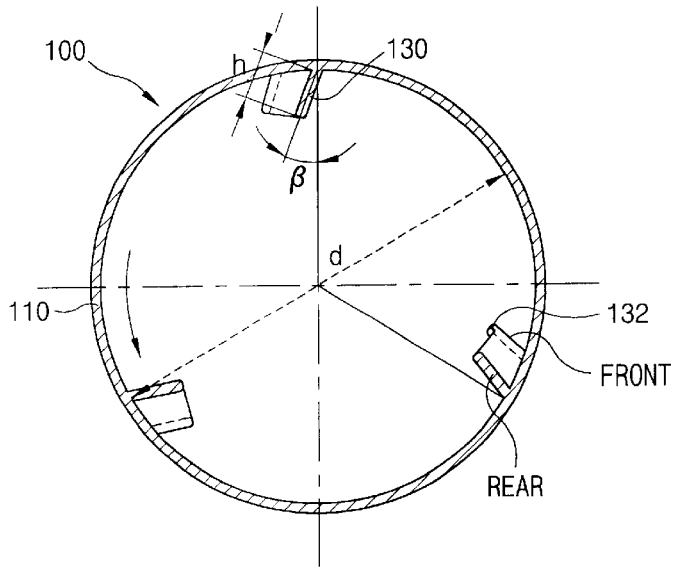
FIG. 17 is a longitudinal sectional view illustrating a drum for a cloth dryer in accordance with a sixth embodiment of the present invention.
Figure 18:
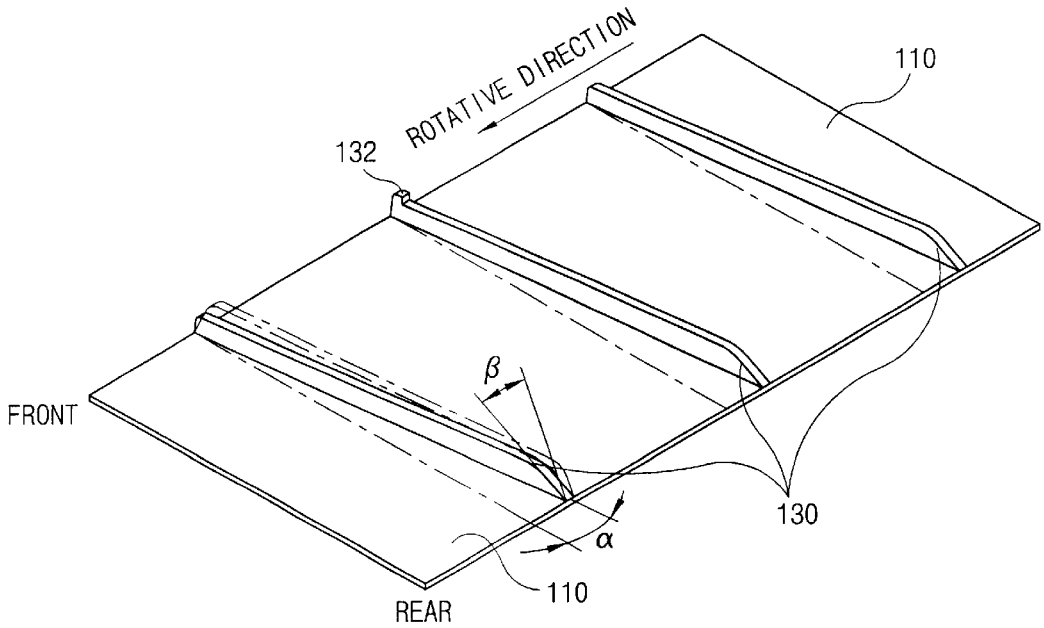
FIG. 18 is a perspective view illustrating the drum for the cloth dryer in accordance with the sixth embodiment of the present invention.

FIG. 17 is a longitudinal sectional view illustrating a drum for a cloth dryer in accordance with a sixth embodiment of the present invention, and FIG. 18 is a development view illustrating the drum for the cloth dryer in accordance with the sixth embodiment of the present invention.

The drum in accordance with the sixth embodiment of the present invention includes the cylindrical body 110 housing clothes and rotating, and a plurality of baffles 130 projecting from the inner circumference of the cylindrical body 110 in a length-direction of the cylindrical body and formed so as to be inclined with respect to a normal direction of the cylindrical body 110.

The plurality of baffles 130 is formed at regular intervals in the circumferential direction of the cylindrical body 110. An angle of inclination ($\alpha$) of the plurality of baffles 130 is $0° < \alpha \leqq 20°$ toward the length direction of the cylindrical body 110, and an angle of inclination ($\beta$) of the plurality of baffles 130 is $0° < \beta \leqq 45°$ toward the normal direction of the cylindrical body.

The height (h) of the baffles 130 is the same each other, and a ratio (h/d) of the height (h) of each baffle 130 to the inner diameter (d) of the cylindrical body is within the range of 1/10~2/10.

A protrusion portion 132 having a certain height is formed at the end of a certain baffle of the baffles 130.

Figure 19:
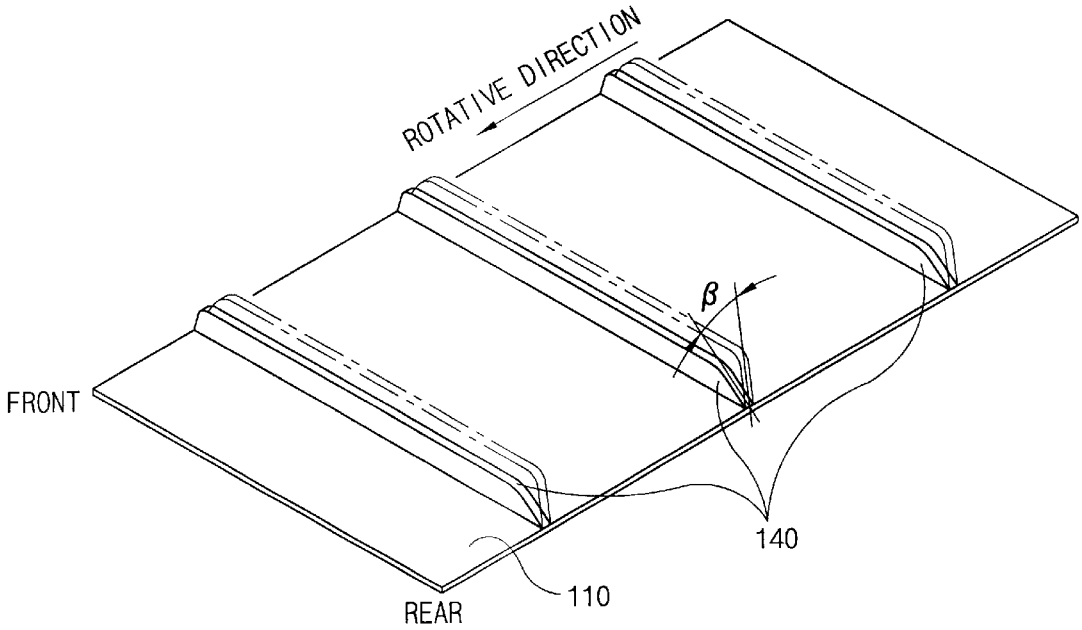
FIG. 19 is a perspective view illustrating a drum for a cloth dryer in accordance with a seventh embodiment of the present invention.

FIG. 19 is a perspective view illustrating a drum for a cloth dryer in accordance with a seventh embodiment of the present invention.

As depicted in FIG. 19, in the drum in accordance with the seventh embodiment of the present invention, a plurality of baffles 140 are formed so as to have an angle of inclination ($\beta$) toward the normal direction of the cylindrical body 110 and are placed at regular intervals in the circumferential direction of the cylindrical body 110.

The baffles 140 are formed so as to be inclined with respect to the rotational direction.

In the clothes dryer in accordance with the sixth and seventh embodiments of the present invention, because a plurality of baffles are formed so as to be inclined with respect to the length direction and the normal direction of the drum 100, the clothes can be regularly dispersed and moved inside the drum 100, and resistance air against air flow can be minimized by preventing the clothes from gathering around the exhaust port 62, thereby reducing load on the fan and noise attendant with the drying process. By improving clothes drying efficiency, clothes drying time can be shortened, and power consumption can be minimized.

Figure 20:
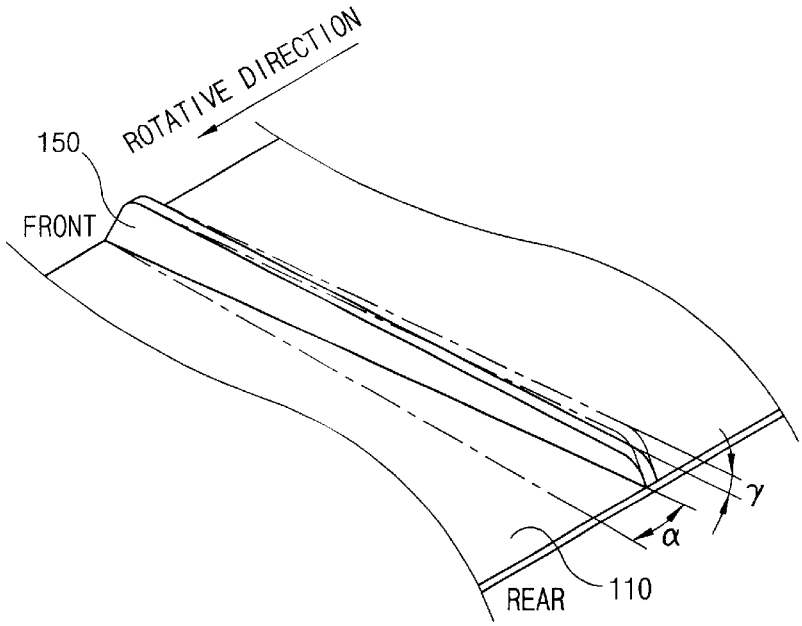
FIG. 20 is a perspective view illustrating a drum for a cloth dryer in accordance with an eighth embodiment of the present invention.

FIG. 20 is a perspective view illustrating a drum for a clothes dryer in accordance with an eighth embodiment of the present invention.

As in the fifth embodiment, in the clothes dryer in accordance with the eighth embodiment of the present invention, a plurality of baffles 150 are formed so as to have an angle of inclination ($\alpha$) toward the length direction of the cylindrical body 110.

Each of the baffles 150 is formed so as to be inclined. The height of the baffles 155 abutting the front plate 60 is greater than the height of the baffles 150 abutting the rear plate 50.

Herein, an angle of inclination ($\gamma$) of the plurality of baffles is $0° < \gamma \leqq 10°$.

In the clothes dryer in accordance with the eighth embodiment of the present invention, because the baffles 150 are formed so as to have a larger engaging area toward the exhaust port of the front plate 60, it is possible to prevent the clothes from gathering around the exhaust port 62.

Figure 21:
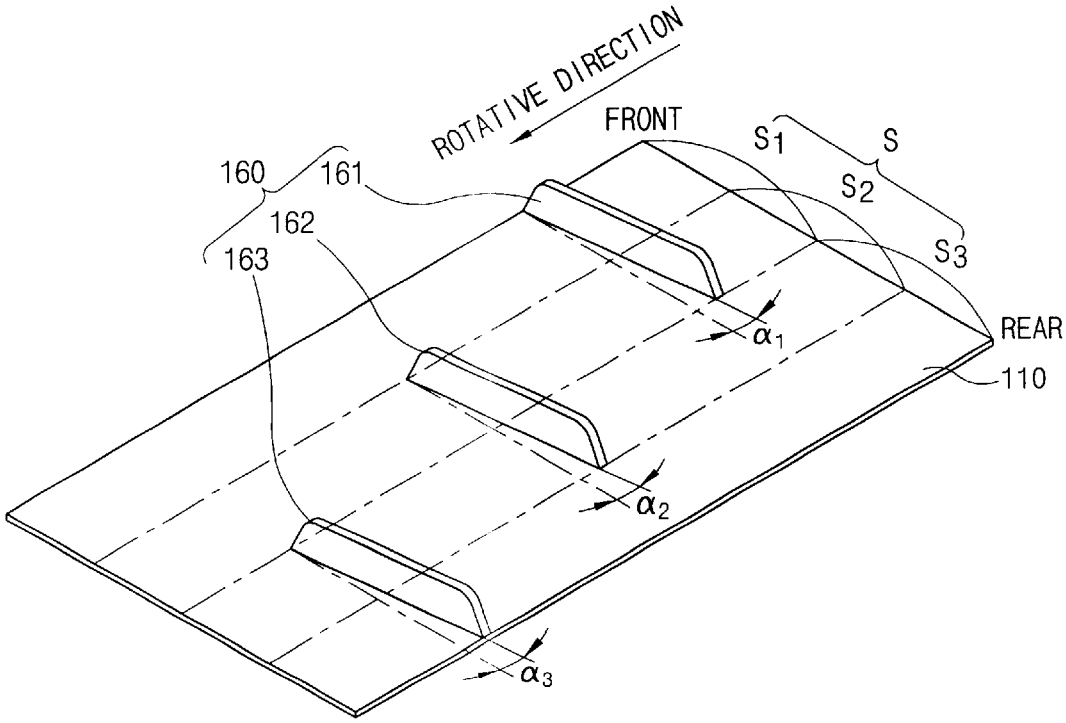
FIG. 21 is a development view illustrating a drum for a cloth dryer in accordance with a ninth embodiment of the present invention.

FIG. 21 is a perspective view illustrating a drum for a cloth dryer in accordance with a ninth embodiment of the present invention.

The ninth embodiment of the present invention combines the construction of the first embodiment with the construction of the fifth embodiment.

As depicted in FIG. 21, in the clothes dryer in accordance with the ninth embodiment of the present invention, each baffle 161, 162, 163 is installed at each disposal domain (S1), (S2), (S3) so as to have a regular length toward the length direction of the cylindrical body 110.

In addition, the baffles 161, 162, 163 are formed so as to be inclined with respect to the length of the cylindrical body 110. Although each baffle 161, 162, 163 has the same angle of inclination ($\alpha_1$, $\alpha_2$, $\alpha_3$) in the shown embodiment, baffles having different angles of inclination according to design conditions are considered within the scope of the present invention.

In the clothes dryer in accordance with the ninth embodiment of the present invention, each baffle 161, 162, 163 can be variously formed at each disposal domain as in the second through fourth embodiments, or each baffle 161, 162, 163 can be formed so as to have various angles of inclination and heights as in the sixth through eighth embodiments.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such metes and bounds are therefore intended to be embraced by the appended claims.

What is claimed is:

1. A drum for a clothes dryer, comprising:

a cylindrical body housing clothes and rotating; and a plurality of baffles projected from the inner circumference of the cylindrical body in a length direction of the cylindrical body and lifting the clothes, wherein the plurality of baffles are formed so as to be inclined with respect to both the length direction of the cylindrical body and a normal direction of the cylindrical body, and wherein the cylindrical body sucks air through the side surface and discharges air through the other side surface, and at least one of the baffles has a protrusion portion projected from the end of the side at which air is discharged and having a certain height.

2. A drum for a clothes dryer, comprising:

a cylindrical body housing clothes and rotating; and a plurality of baffles projected from the inner circumference of the cylindrical body in a length direction of the cylindrical body and lifting the clothes, wherein the plurality of baffles are formed so as to be inclined with respect to both the length direction of the cylindrical body and a normal direction of the cylindrical body, and wherein the cylindrical body sucks air through the side surface and discharge air through the other side surface, and the baffles placed at the side surface at which air is sucked are formed so as to be lower than the baffles placed at the other side surface at which air is discharged, in the position lifting the clothes.

3. A drum for a clothes dryer, comprising:

a cylindrical body housing clothes and rotating; and a plurality of baffles projected from the inner circumference of the cylindrical body in a length direction of the cylindrical body and lifting the clothes, wherein the plurality of baffles are formed so as to be inclined with respect to both the length direction of the cylindrical body and a normal direction of the cylindrical body, wherein the plurality of baffles are formed so as to be inclined from a first end portion abutting on the inner diameter of the cylindrical body to a second end portion, and wherein the cylindrical body sucks air through the side surface and discharges air through the other side surface, and the baffles placed at the other side surface at which air is discharged are formed so as to be higher than the baffles placed at the side surface at which air is sucked.

4. A drum for a clothes dryer, comprising:

a cylindrical body housing clothes and rotating; and a plurality of baffles projected from the inner circumference of the cylindrical body in a length direction of the cylindrical body and lifting the clothes, wherein the plurality of baffles are formed so as to be inclined with respect to both the length direction of the cylindrical body and a normal direction of the cylindrical body, wherein the plurality of baffles are formed so as to be inclined from a first end portion abutting on the inner diameter of the cylindrical body to a second end portion, and wherein an angle of inclination ($\gamma$) of the height variation of the plurality of baffles is $0° < \gamma \leqq 10°$.

* * * * *

UNITED STATES PATENT AND TRADEMARK OFFICE

CERTIFICATE OF CORRECTION

PATENT NO. : 6,698,107 B2
DATED : March 2, 2004
INVENTOR(S) : Sung Bae Song et al.

It is certified that error appears in the above-identified patent and that said Letters Patent is hereby corrected as shown below:

Title page,
Item [54], Title, change the title from "DRUM FOR CLOTHES DRIER" to
-- DRUM FOR CLOTHES DRYER --.

Signed and Sealed this

Twenty-fourth Day of August, 2004

JON W. DUDAS
*Director of the United States Patent and Trademark Office*